United States Patent [19]

Gulitz et al.

[11] 4,059,385

[45] Nov. 22, 1977

[54] COMBUSTION MONITORING AND CONTROL SYSTEM

[75] Inventors: Louis Gulitz, Yorktown Heights; Theodore William Kwap, Brewster; Walter Irving Lisle, Stone Ridge, all of N.Y.; Daniel Francis O'Kane, Morgan Hill, Calif.; Michael Robert Poponiak, Newburgh, N.Y.

[73] Assignee: International Business Machines Corporation, Armonk, N.Y.

[21] Appl. No.: 708,527

[22] Filed: July 26, 1976

[51] Int. Cl.[2] ..... F23N 5/10

[52] U.S. Cl. ..... 431/12; 431/76; 431/79; 431/90

[58] Field of Search ..... 431/76, 12, 90, 79; 178/6.8, DIG. 6, DIG. 8

[56] References Cited

U.S. PATENT DOCUMENTS

| | | | |
|---|---|---|---|
| 3,718,757 | 2/1973 | Gulitz et al. | 358/113 |
| 3,733,166 | 5/1973 | Swithenbank et al. | 431/76 |
| 3,988,104 | 10/1976 | Barber | 431/90 |

OTHER PUBLICATIONS

Gulitz et al., *Computerized Control System for Improved Combustion Efficiency*, July 1975, IBM Technical Disclosure Bulletin vol. 18 No. 2.

*Primary Examiner*—Edward G. Favors

*Attorney, Agent, or Firm*—James M. Thomson

[57] ABSTRACT

A real time monitoring and control system for single or multi-fired combustion systems which permits adjustment of the air fuel ratio in the system for optimized efficiency and minimized pollution content in the exhaust gas, while providing safety control of the combustion process. The system includes a high sensitivity light sensor which is utilized to monitor the combustion flame and provide an electrical output proportional to flame temperature, that is utilized to control the air fuel ratio of the system. The wavelength sensitivity of the sensor is capable of selection, for example by selection of sensor type and/or use of appropriate filters, to monitor a predetermined range or region of the flame emission spectrum in order to enable correlation of the intensity of the emission spectrum of the type of fuel being utilized, i.e., oil or natural gas, with temperature and combustion efficiency. A sensor having a defined field of view is utilized and means are provided to sample signals from selected portions of the field of view of the sensor to enable temperature monitoring of a multi-flame system. The output of the sensor is provided to a computer which in turn is electrically connected to control a valve that individually adjusts the air fuel ratio of each flame of the system to permit real time adjustment of the combustion process. The system enables control of combustion at or near optimum burning efficiency, i.e., in the range of ½ to 1 percent excess oxygen.

8 Claims, 3 Drawing Figures

COMBUSTION MONITORING AND CONTROL SYSTEM

BACKGROUND OF THE INVENTION

1. Field of Invention

The present invention relates to a real time monitoring and control system for combustion systems. More particularly, the invention concerns a real time monitoring and control system that utilizes a high sensitivity light sensor that monitors the flame of a single or multi-flame combustion system and produces an output that is proportional to the temperature of the flames, which is utilized in a feed-back control type system operating in real time to adjust the air fuel ratio of the flame to an optimum burning level.

2. Description of the Prior Art

Various systems exist in the prior art for monitoring combustion systems for the purpose of adjusting the combustion efficiency to an ideal figure, and/or to provide safety control of the combustion process. Many such safety systems utilize a detector which senses the presence or absence of the flame itself in the combustion chamber and produces a signal which can be utilized to shut down the burner should the flame extinguish. These systems provide adequate safety control but generally utilize a low sensitivity detector for monitoring the flame since all that is desired is to detect its presence or absence.

Other systems which adjust the combustion efficiency of the system utilize means for sensing the content of oxygen or other constituents in the flue gas and producing a single which can be utilized to control input parameters of the system, such as air fuel ratio, for example. It should be recognized that the use of an oxygen sensor in the exhaust or flue chamber of a combustion system may be adequate to sense the combustion characteristics of a single flame system, if adjustment to a combustion efficiency in the range of 4 to 8 percent of excess oxygen is satisfactory. However, due to the inherent time delay involved in monitoring oxygen content down-stream from the combustion chamber, wherein a large thermal mass or volume of gasses circulating within the furnaces usually requires up to several minutes between sensing temperature variations and correction thereof, changes cannot be affected with sufficient rapidity to control combustion efficiency to an excess oxygen state much lower than the 4 percent range with usual furnace conditions. Moreover, when it is desired to monitor and control a multi-flame system, the use of a down-stream oxygen monitor is less efficient since the oxygen monitor gives no indication whether one or more of the multiple flames are operating at optimum efficiency, i.e., it simply averages the efficiency of the multi-flame system.

Other combustion control systems utilize discrete temperature sensing devices such as thermocouples located within the combustion chamber itself as an indication of the efficiency of combustion. However, such systems have not been designed to provide better control efficiency than the oxygen monitoring type systems since the temperature sensing devices, as well, involve a response time which prevents real time adjustment of the flame. Moreover, it is difficult to arrange temperature monitoring devices of discrete type within the combustion so as to accurately measure the combustion temperature of more than one given position of a selected flame of a multi-flame system.

Accordingly, a need exists for a flame monitoring and control system which can provide real time monitoring of combustion temperature in a single or multi-fired system whereby the air fuel ratio of the system can be adjusted to the lowest possible excess oxygen level in order to optimize the efficiency of the system. Such a system, when applied to furnaces utilized for heating or other purposes could result in significant savings in fuel usage and operating costs. Moreover, it has been recently recognized that pollution control can be achieved through such a system since in the usual combustion process complete burning resulting in lower pollutant constituents occurs with maximum or close to maximum combustion efficiency. Consequently, such a system could be utilized to control sulphur dioxide, carbon monoxide and nitride pollutants, etc. Finally, a need exists to combine such a system with means for providing fail safe control over the combustion process in such large multi-fired furnaces.

SUMMARY OF THE INVENTION

Accordingly, it is an object of the invention to provide a real time monitoring and control system for single or multi-fired combustion systems which utilizes high sensitivity light sensing means for providing an electrical signal output which is proportional to flame temperature which can be utilized in a control system to effect real time adjustment in the air fuel ratio of the combustion system whereby optimum combustion can be attained in the system, while minimizing pollutant content in the exhaust and providing a signal which can be utilized to shut down the system should flame-out occur.

This object and other features and advantages of the invention are attained in a monitoring and control system adapted for use with combustion systems such a single or multi-fired furnaces utilized in electric power installations or in industrial or residential complexes. The system includes a sensor which is responsive to light, i.e., a combination of ultraviolet, visible and infrared radiation, and which produces an output signal that is proportional to the temperature of the light source. The sensor is a high sensitivity device, by this it is meant that it exhibits a sensitivity in the order of 0.5 amp watt$^{-1}$ cm$^{-2}$ which is greater than that of conventional photo diode arrays, and is responsive over a fairly broad frequency range. It has been found that a sensor with a sensitivity of at least 0.2 amps watt$^{-1}$ cm$^{-2}$ can be utilized in the system described herein, however. The sensor has a defined field of view and the output of the sensor is preferably supplied to sampling circuitry which enables sampling of the electrical signal at particular points within the field of view of the sensor at which temperatures are to be determined. The output of the sampling circuitry is displayed on a monitor, and supplied to a computer whereby a systematic analysis of the temperature of single or multi-flame spots within the field of view of the sensor can be monitored. The computer evaluates the input data and produces an output signal which is utilized to control the main fuel feed to the furnace, as well as the air fuel ratio for each of the flames within the furnace. Adjustment by the computer enables operation of each individual flame within the combustion chamber at an optimum level of efficiency, i.e., with the air fuel ratio being maintained just slightly on the excess oxygen side of combustion whereby complete combustion is attained.

In the usual prior art system the air fuel ratio generally operates in the range of 4 to 8 percent excess oxygen, whereas in the present system it has been found that an air fuel ratio of the order of ½ to 1 percent excess oxygen can be attained, with a commensurate increase in operating efficiency of the system. This is made possible since the relative temperature of the flame is detected by sensing a narrow wavelength band and utilized as the best indication of burning efficiency of the flame, and since the adjustment of air fuel ratio is maintained on a real time basis without the usual delay inherent in utilizing back-end or flue monitoring.

BRIEF DESCRIPTION OF THE DRAWINGS

The foregoing and other objects, features and advantages of the invention will be apparent from the following detailed description when read with the accompanying drawings wherein.

DETAILED DESCRIPTION OF THE INVENTION

Figure 1:
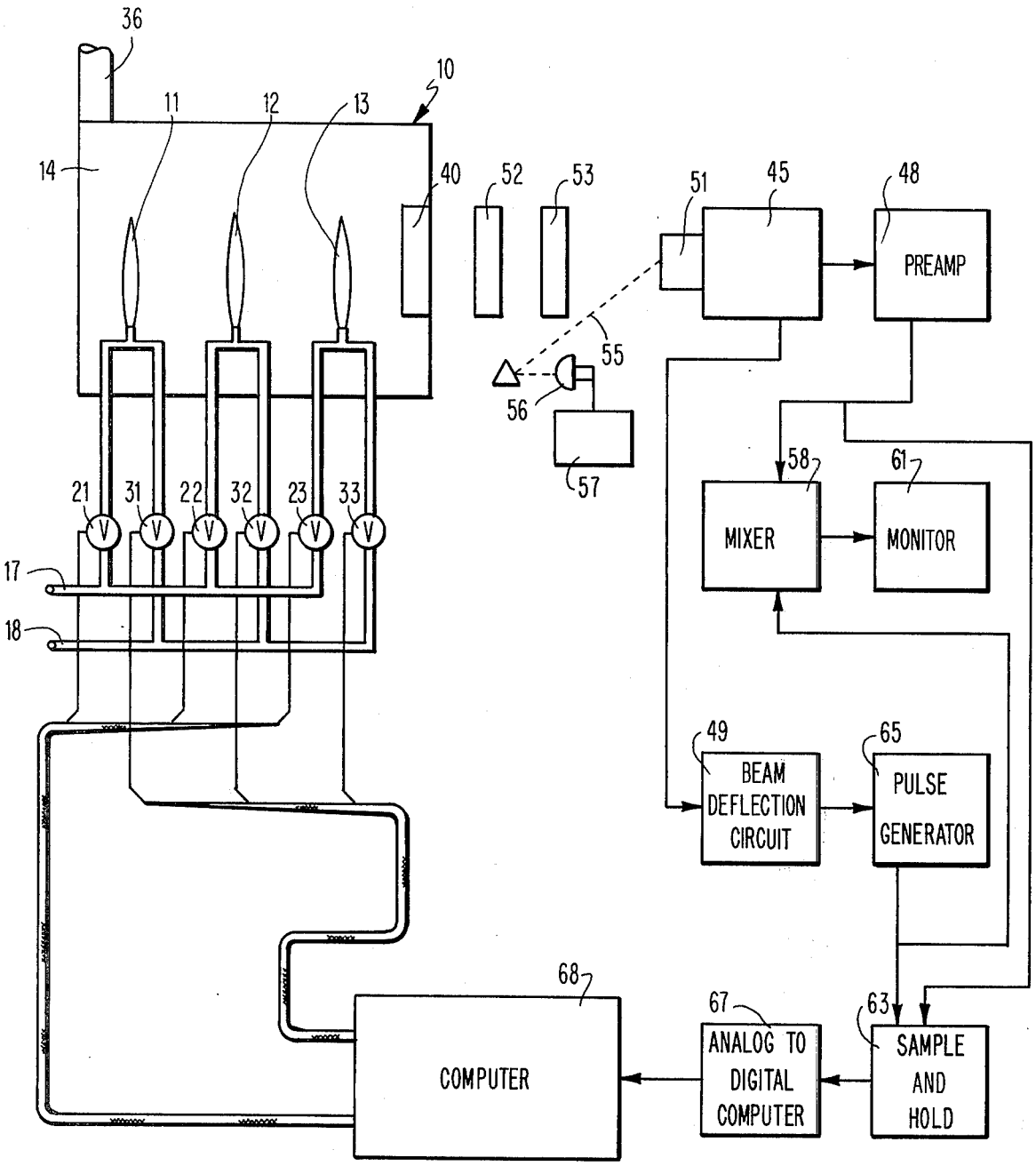
FIG. 1 is a schematic diagram of one preferred embodiment of the invention.

Referring now to the drawings and particularly to FIG. 1, one preferred embodiment of the invention is illustrated comprising a monitoring and control system adapted for controlling the combustion efficiency of a single or multi-fired furnace such as that identified by numeral 10, for example. Furnace 10 is illustrated as a multi-flame system including flames 11, 12, and 13, for example. However, it should be recognized that the furnace could be a single flame system or might include a greater number of flames, as well. In the usual fashion, the flames are contained within a combustion chamber 14 that is schematically illustrated and are served by fuel lines from a main line 17, as well as by an air or oxygen line 18. It should be recognized that an individual fuel valve, such as valves 21, 22, 23, is associated with each flame; and an individual air valve, such as valves 31, 32, 33, is likewise associated with each flame whereby individual control of the flames is possible. The valves are schematically illustrated but comprise conventional valves responsive to electrical control signals in a fashion described hereinafter. The combustion chamber otherwise includes a usual discharge flue, such as that illustrated by numeral 36.

The wall of chamber 14 is also provided with a window 40 through which a sensor 45 can be placed in light receptive relationship with the flames in the furnace. The window 40 can be closed with an appropriate sheet of glass, quartz or other transmissive material capable of withstanding the temperatures within the furnace. If preferred, means can be included to direct a stream of gas, such as oxygen or nitrogen, past the inner surface of window 40 to prevent particulate accumulation.

Figure 3:
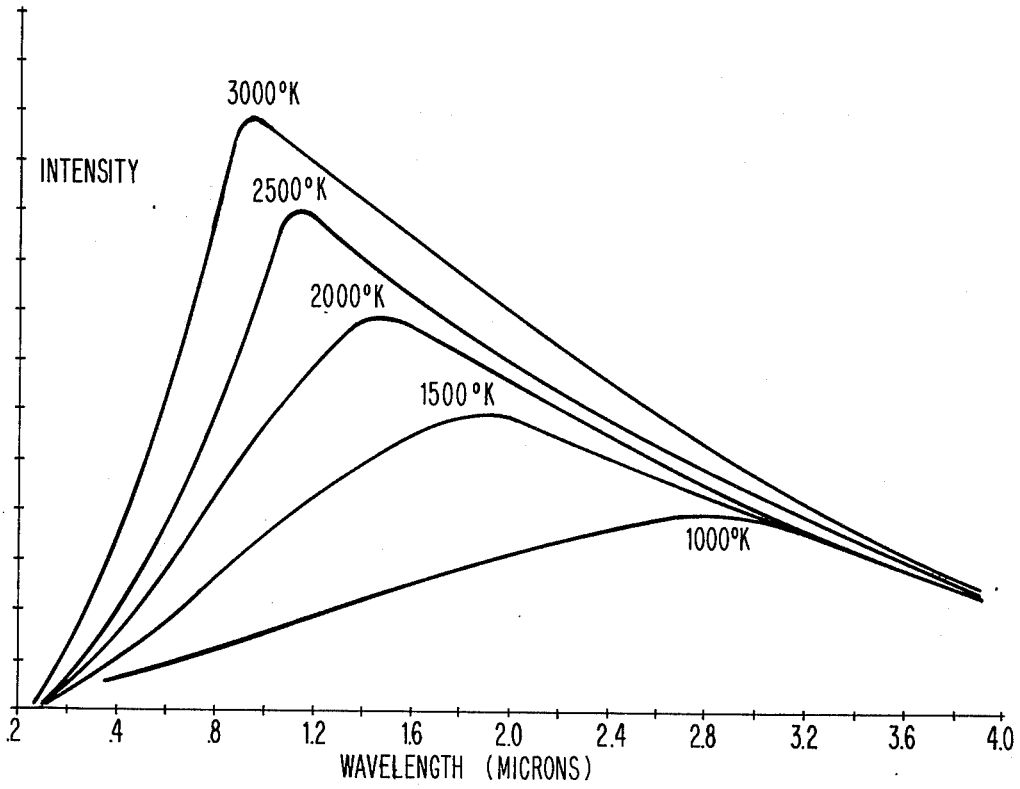
FIG. 3 is a graph illustrating the characteristics of an ideal black body radiator.

Sensor 45 is a light responsive sensor of high sensitivity which responds to light in the visible, ultraviolet and infrared regions and produces an output signal that is proportional to the temperature of the light or flame sensed. The manner in which such correlation is attained may be understood by first referring to FIG. 3 which is a graph illustrating the temperature versus wavelength characteristics of an ideal or black body radiator. As shown, with an ideal radiator the emission wavelength varies in the fashion illustrated from a value of 0.97 to 3 micro meters as the temperature in degrees Kelvin varies over a range of 3,000° to 1,000°.

It should be realized that for certain flames, black body radiation does not occur. For example, natural gas flames include only a portion of the blue region of the visible spectrum whereas the normal visible region is greatly subdued. On the other hand, oil flames exhibit substantially more of the wavelengths of the visible spectrum. In addition, within the region of the spectral response of the usual detector, various emission and absorption bands occur, some of which can be identified or correlated to the existence of pollutant gases such as sulphur dioxide, carbon monoxide, nitrogen oxide and nitrogen dioxide, for example. The aforementioned pollutant gases all have absorption spectral in the ultra violet region of the visible spectrum, for example.

Furthermore, sporadic bands of radiation occur at various points in the emission spectrum of various fuels due to luminescent type peaks caused by fuel contaminants, for example.

Figure 2:
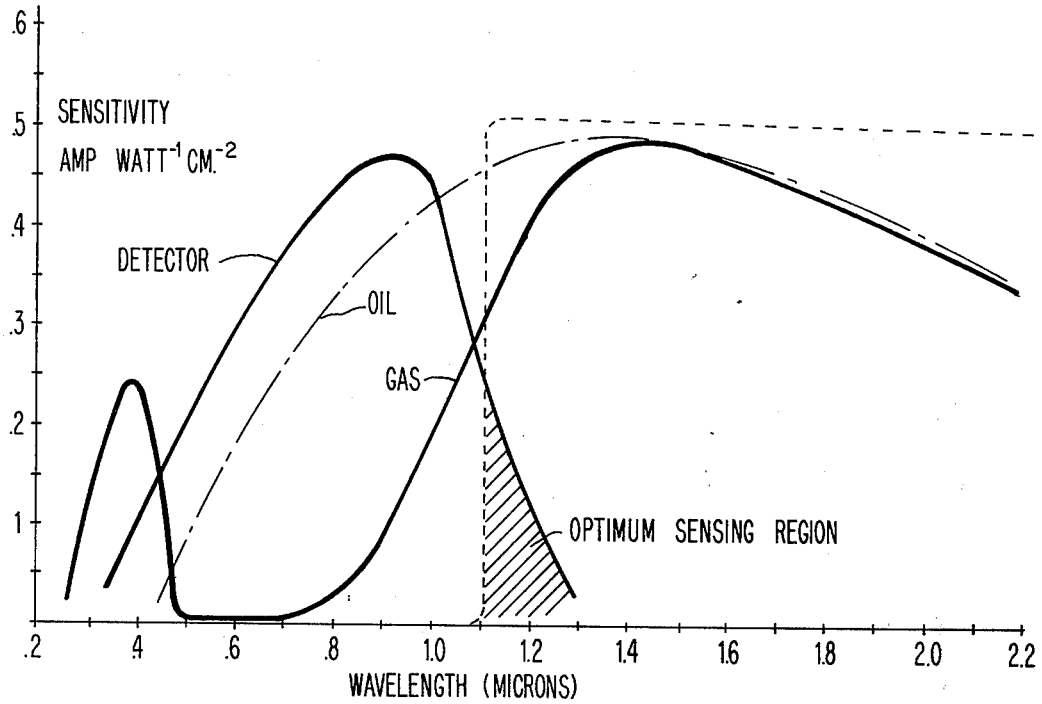
FIG. 2 is a graph illustrating flame characteristics of oil and gas combustion superimposed upon a a graph of the sensitivity versus wavelength for a sensor utilized in the system described herein.

Referring now to FIG. 2, a composite plot is illustrated which includes a graph of wavelength versus emission characteristics for typical oil and natural gas fuels superimposed upon a graph of the sensitivity versus wavelength for a sensor utilized in the preferred system described herein.

More particularly, the graph for the oil emission spectrum is illustrated as an even curve extending from 0.4 micrometers to a region well above 2.2 micrometers with a peak in the 1.3 micrometer region. In similar fashion, the graph for natural gas emission is illustrated as a smooth curve having peaks in the region of 0.4 micrometers and 1.4 micrometers, with a pronounced valley in the 0.6 micrometer region. It should be recognized that the graphs for both oil and natural gas do not include spurious or sporadic emission peaks which are known to exist in the curve with particular intensity at certain wavelengths. For example, emission peaks occur at 2.8 and 4.4 micrometers due to the existence of $CO_2$; a peak occurs at 0.57 micrometers due to $NO_x$; and a peak occurs at 0.33 micrometers due to $SO_2$. It should be recognized, however, that numerous other emission peaks occur at other wavelengths due to various fuel constituents.

The graph illustrating the sensitivity of a preferred sensor for the present system includes a peak sensitivity in the region of 0.9 micrometers with rather sharply declining slopes extending in either direction therefrom. Under ideal conditions, the peak sensitivity of the sensor might be expected to match that of the emission spectrum to be monitored. However, due to the aforementioned spurious emission peaks, it has been found that the optimum sensing region for controlling combustion efficiency with the referred sensor is the identified region existing between 1.1 and 1.3 micrometers for oil flames. This region has been found to be essentially free of interfering emissions of spurious nature, while at the same time producing a representative region which can be utilized to obtain a signal indicative of optimum combustion. In this regard, it should be recognized that the indicated region will not necessarily reflect a signal representative of the hottest temperatures in the flame. However, if the combustion of the system is adjusted to maximize emission in the region indicated, the overall emission spectrum will be essentially optimized. Furthermore, it should be recognized that the sensitivity of the sensor in the indicated region is not the maximum value. However, in view of the high sensitivity of the sensor utilized, the response in the region of optimum sensing is sufficient to produce a suitable output signal.

In the case of an oil flame, a silicon filter is utilized in conjunction with the preferred sensor, having a narrow band characteristic as illustrated which is sharply defined at 1.1 micrometers. This has the effect of screening out radiation below 1.1 micrometers so that, in conjunction with the natural sensitivity of the sensor, only radiation in the desired band is monitored. In the case of a natural gas flame, the silicon filter is not necessary since the emission falling within the region defined between 0.8 and 1.3 micrometers has been found to be acceptably free of spurious emission.

Alternatively, it has been found that an ultraviolet responsive vidicon tube, having a sensitivity that peaks in the region of 0.4 micrometers could be utilized satisfactorily in the case of gas flames. From the graph of FIG. 2, it should be apparent that such a vidicon would essentially straddle the lower peak of the gas emission spectrum. It has been found that this peak is sufficiently free of spurious emission to produce a signal suitable for adjustment of combustion efficiency, when monitored by a sensor having a sufficiently high sensitivity to read it with accuracy. Again, it is envisioned that monitoring of the lower peak of the gas spectrum would be carried out without a silicon filter.

Referring now to FIG. 1, sensor 45 is preferably comprised of a silicon target vidicon tube having the sensitivity illustrated in FIG. 2. Such a vidicon is commercially available from RCA having a Model No. 8507A. An ultraviolet responsive vidicon or an infrared pyricon tube, could be utilized as well. All such units have a well defined field of view which enables viewing of multi-flame systems. Such a unit would be utilized with a high gain, low noise preamplifier 48 and associated beam deflection electronics unit 49. The sensor might also comprise a charge coupled optical scanner, provided a sufficiently high sensitivity unit were utilized.

An appropriate optical lens 51 is utilized between the sensor and window 40; with the size and area to be sensed dictating the characteristic focal length of the lens. In addition, a filter or filters 52, 53 can be utilized behind the lens, if preferred, to provide appropriate wavelength screening depending upon a particular fuel being used in the furnace. For example, in order to achieve the wavelength sensitivity illustrated in FIG. 2 for an oil flame, a silicon filter would be utilized as filter 53, and a composite filter comprising 1.0 and 1.6 neutral density filters would be used as filter 52.

An optical path 55 is illustrated in alignment with the sensor adapted to receive radiation from a standard light source 56 which provides calibration capability and electronic stability control under the control of power source 57.

If a silicon target vidicon is utilized, the output of sensor 45 comprises a video signal which is supplied to a mixer 58 and then to a display monitor 61 which is a conventional unit adapted to display the X-Y location in the field of view of the vidicon of the video voltage to be measured. The video signal is also supplied as an input signal to a sample and hold circuit 63 which receives another input signal from deflection circuit 49 via generator 65 which selectively enables sample and hold circuit 63. Consequently, as the signal from pulse generator 65 occurs the video signal from sensor 45 corresponding in time thereto is sampled. Mixer 58 also receives an output from generator 65, as illustrated.

The output of sample and hold circuit 63 is supplied to an analog to digital converter 67 which is provided, if necessary, to change the format of the output signal to a suitable form for utilization.

The sensor and control circuitry described herein as part of the preferred embodiment are of a type particularly described in U.S. Pat. No. 3,718,757 which is assigned to the assignee of the present invention.

It should be recognized that other sensor units could be utilized in the present system as well, provided that they incorporate the capability to monitor a flame over a defined field of view and the capability to sample the flame intensity at selected points within the field of view of the sensor to facilitate the monitoring of multi-flame systems. Moreover, such systems should preferably include the capability for integrating the output of the sensor over a plurality of adjacent monitoring points whereby a more uniform and accurate indication on the intensity of a given flame can be obtained. Such integrating capability can be carried out in a computer 68 utilized in the system described herein.

The output of circuit 67 is provided as an input of general purpose computer 68 in well known fashion. In the preferred embodiment an IBM 5100 computer can be utilized to control and maintain proper combustion. As shown, the computer provides an electrical output signal to the air valve and fuel valve of each individual flame of the system. Accordingly, the air fuel ratio of each flame can be individually adjusted.

In operation, the computer serves to adjust the air fuel ratio of each air valve, as well as the fuel flow to each flame for a maximum burning efficiency with minimum pollution. This adjustment is usually carried sequentially, flame by flame, during start up, with monitoring in a preselected sequence at desired intervals after optimum conditions are attained. In the usual system it has been found that operating the individual burners at an air fuel ratio of ½ to 1 percent excess oxygen is possible without risking flame-out. This is opposed to the usual system wherein a comparable figure of 4 to 8 percent excess oxygen is usual. Another advantage of the system described herein is the quick response available. Thus, flue measurements effected in typical prior art systems require at least 1 to 4 minutes in medium boiler systems to respond to any change in the flame. This is due to the large thermal mass or volume of gases in the systems. Even additional time is required for the monitor to reach a steady state condition. Consequently with the present system significant fuel savings can be achieved with immediate response available.

Moreover, the system can be utilized for safety in monitoring inasmuch as the sensor determines whether the pilot or main flame on each burner it lit. In the event burn-out occurs the main fuel system can be shut off by the computer within seconds.

While the invention has been particularly shown and described with reference to the preferred embodiments thereof, it will be understood by those skilled in the art that various changes in form and details may be made therein without departing from the spirit and scope of the invention.

What is claimed is:

1. A real time monitoring and control system for adjusting combustion in a system having air and fuel supplies to at least one flame to optimum burning efficiency, including sensing means responsive to a preselected portion of the emission spectrum of the flame for producing an electrical output signal proportional to the temperature of the flame, said sensing means having a sensitivity of at least 0.2 amps watt$^{-1}$ cm.$^{-2}$, and computer means responsive to said sensing means for adjusting the air fuel ratio of said supplies to maximize the burning temperature of said flame.

2. The control system of claim 1 wherein said sensing means comprises:

a vidicon tube having a predetermined field of view and wherein said system further includes means receiving the output of said sensing means for correlating the instantaneous level of the output signal of said vidicon tube to a predetermined region of the field of view of said tube.

3. The system of claim 2 further including filter means oriented between the flame and the field of view of said tube for screening out from said tube radiation having a wavelength below 1.1 micrometers.

4. The system of claim 2 wherein said sensing means comprises a vidicon tube responsive to emission wavelengths at least between 1.1 and 1.3 micrometers.

5. The system of claim 1 wherein said sensing means comprises an ultraviolet responsive television tube having a predetermined field of view with a sensitivity of at least 0.2 amps watt$^{-1}$ cm.$^{-2}$ over an emission wavelength extending at least between 0.3 and 0.4 micrometers.

6. A method of monitoring and adjusting combustion in real time in a system having air and fuel supplies to at least one flame including the steps of sensing a preselected portion of the emission spectrum of the flame with a light sensing means having a predetermined field of view for producing an electrical signal proportional to the temperature of the emission spectrum;

selecting with beam deflection and display means a component of said electrical signal which corresponds to a desired region of the field of view of the sensing means; and adjusting the air and fuel supplies of said system by a computer responsive to said component of said electrical signal to maximize the combustion temperature within the system and thereby optimize combustion efficiency.

7. The method of claim 6 wherein said sensing means has a sensitivity of at least 0.2 amps watt$^{-1}$ cm.$^{-2}$ and wherein the preselected portion of the emission spectrum extends at least between 1.1 and 1.3 micrometers.

8. The method of claim 7 including the further step of filtering with a silicon filter emission having a frequency below 1.1 micrometers.

* * * * *